US005499505A

United States Patent [19]

Gistau-Baguer

[11] Patent Number: 5,499,505

[45] Date of Patent: Mar. 19, 1996

[54] HELIUM REFRIGERATOR WITH COMPRESSOR DRIVE CONTROL

[75] Inventor: Guy Gistau-Baguer, Biviers, France

[73] Assignee: L'Air Liquide Societe Anoneyme Pour L'Etude et L'Exploitation des Procedes Georges Claude, Paris, France

[21] Appl. No.: 271,178

[22] Filed: Jul. 7, 1994

[30] Foreign Application Priority Data

Jul. 23, 1993 [FR] France ..... 93 09092

[51] Int. Cl.[6] ..... F25J 1/00

[52] U.S. Cl. ..... 62/9; 62/37; 62/228.3

[58] Field of Search ..... 62/9, 37, 228.3

[56] References Cited

U.S. PATENT DOCUMENTS

| | | | |
|---|---|---|---|
| 3,307,370 | 3/1967 | Klipping | 62/9 |
| 4,267,701 | 5/1981 | Toscano | 62/9 |
| 4,439,997 | 4/1984 | Cantley | 62/228.3 |
| 4,582,519 | 4/1986 | Someya et al. | 62/9 |
| 4,757,689 | 7/1988 | Bachler et al. | 62/228.3 |
| 5,265,426 | 11/1993 | Gistau-Baguer | 62/9 |

FOREIGN PATENT DOCUMENTS

| | | |
|---|---|---|
| 2446511 | 8/1990 | France . |
| 2679635 | 1/1993 | France . |
| 2168799 | 6/1986 | United Kingdom . |

OTHER PUBLICATIONS

Cryogenic Engineering (JP), Vol. 20, No. 4, 1985, Tokyo, Japan, pp. 224–229, S. Togo et al., "A Helium Refrigerator with Low-Temperature Centrifugal Compressors".

*Primary Examiner*—Ronald C. Capossela
*Attorney, Agent, or Firm*—William S. Frommer

[57] ABSTRACT

The recompression line for the gas in the cold container (7) comprises at least one compressor (C) with which at least a first means ($N_1$) for controlling the speed of rotation of the compressor as a function of parameters (inter alia, flow rate (D), pressure (P)) of the fluid in the line (8) is associated. In order to ensure an adequate fluid flow rate at the inlet of the compressor, the installation comprises a line (9) comprising a pilot-operated valve ($V_1$) and by-passing the compressor, and a line (10) comprising a pilot-operated valve ($V_2$) connecting the inlet line (4) to the compression line (8).

Used, inter alia, in installations for refrigerating superconductive elements.

8 Claims, 2 Drawing Sheets

HELIUM REFRIGERATOR WITH COMPRESSOR DRIVE CONTROL

This invention relates to a refrigerating installation comprising a container containing a biphasic fluid at low pressure and low temperature, especially helium, supplied by a supply line, and a compression line for the gas connected to the container and comprising at least one compressor.

An installation of this kind is described in the document FR-A-2 679 635 in the name of the Applicant.

A refrigerating installation of this kind is used, inter alia, for refrigerating superconductive elements in particle accelerators, in which the pressure of the fluid must be reduced to a very low value of less than 20 hPa in order to obtain a temperature of less than 4.2K in the container. In order to reintroduce the gaseous fluid at this very low pressure into the installation, one, typically several compressors connected in series must be used in the compression line, the operation thereof being difficult to control as a result of instability which may appear in the compression line, particularly in the starting and stopping phases of the installation.

The aim of this invention is to propose an installation with a simple and efficient design for optimising the operation of the compression stages and adjusting the flow rates in the compression line in the different phases of operation of the installation.

To this end, according to one feature of the invention, the installation comprises, associated with the compressor, at least a first means for controlling the speed of rotation of the compressor as a function of parameters of the gaseous fluid upstream of the compressor, typically as a function of at least the flow rate of the fluid upstream of the compressor.

According to other features of the invention:

- the installation comprises a first means for controlling the flow rate of the fluid in the compression line, i.e. intended for the refrigerator downstream of this line, typically a second means for controlling this fluid flow rate;
- the installation comprises, associated with the compressor, a second means for controlling the speed of rotation of the compressor as a function of the pressure upstream of the compressor, the second control means typically being associated with the downstream compressor of the compression line when it comprises at least two compressors connected in series, with each of which one of said first speed control means is associated.

Figure 1:
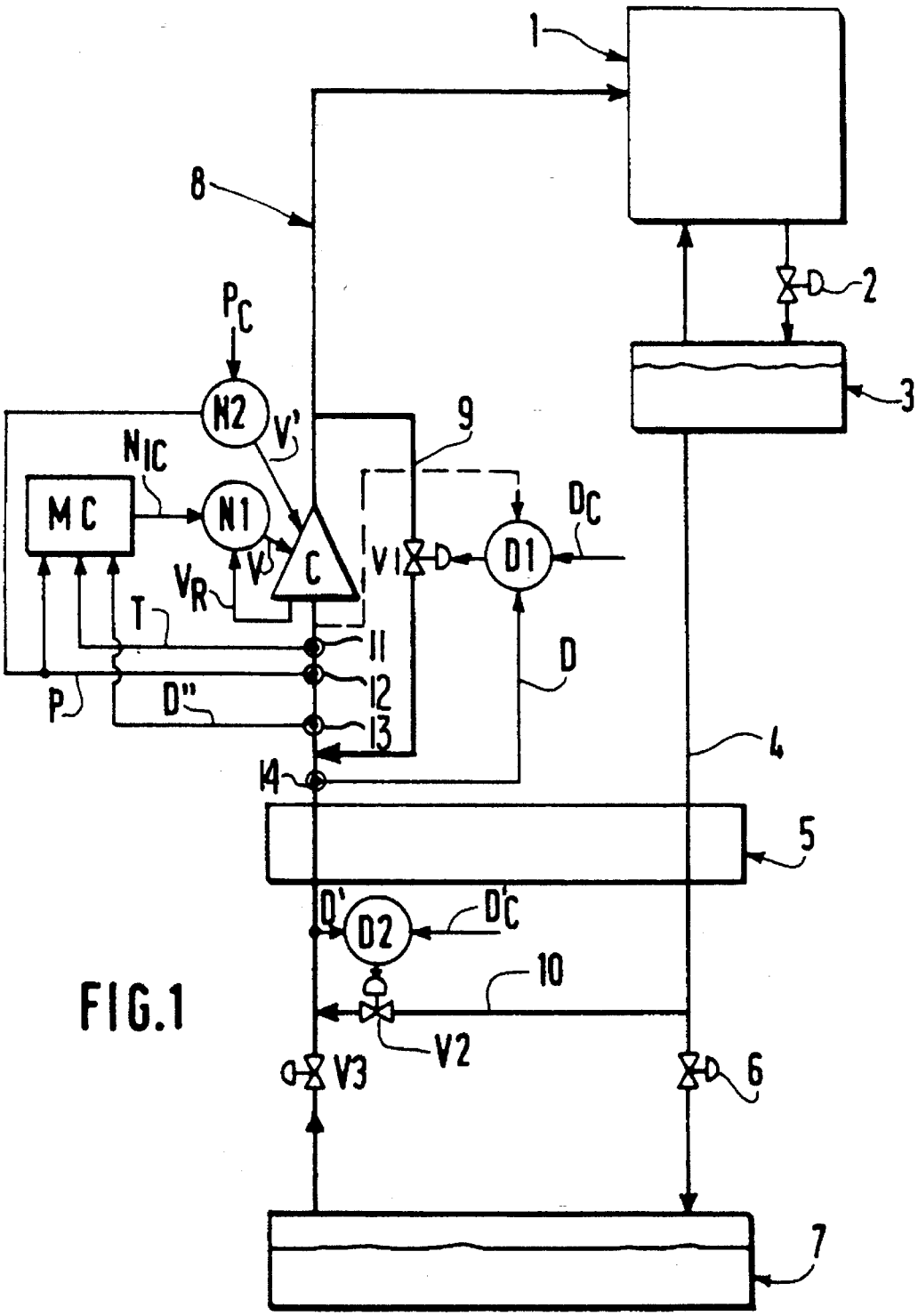
Figure 2:
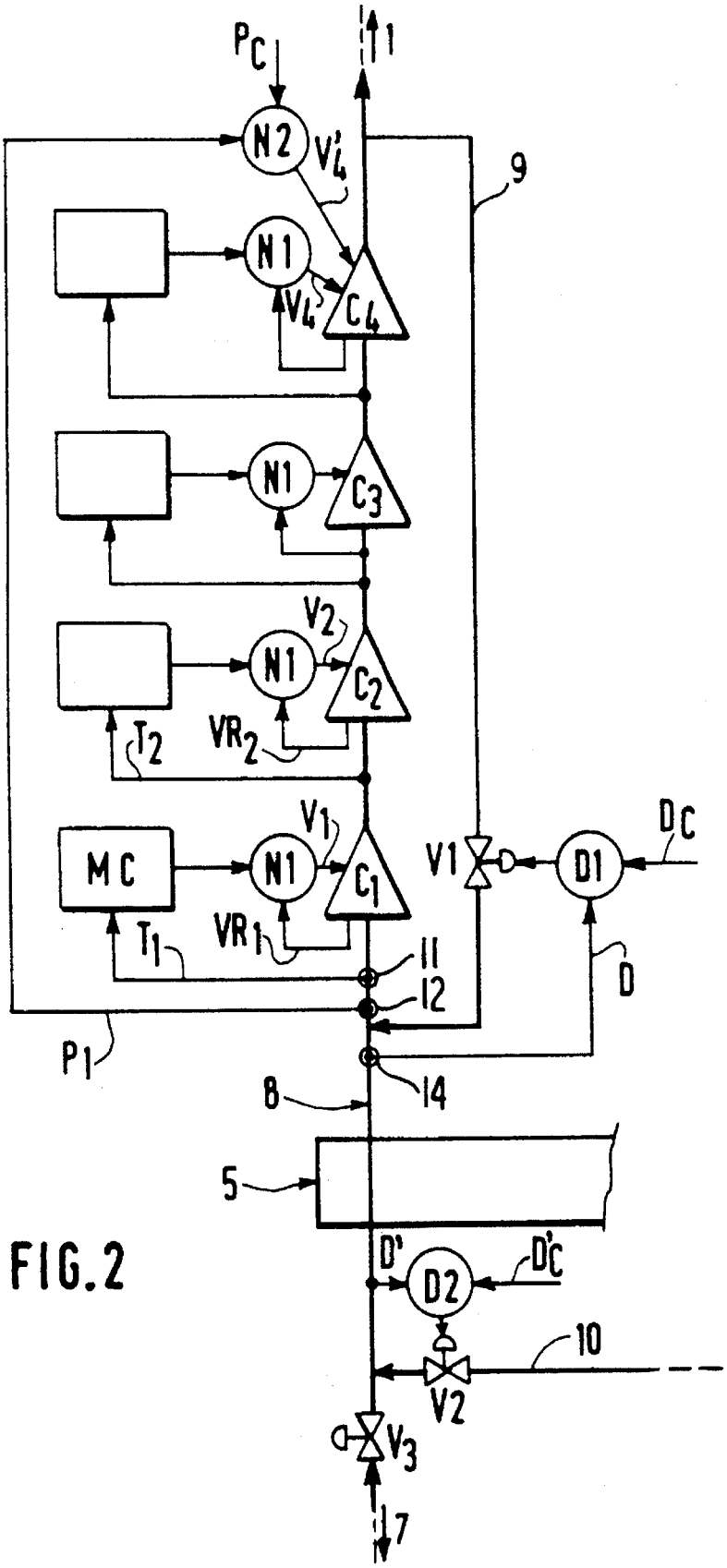

Other features and advantages of this invention will be clear from the following description of embodiments given by way of non-limiting examples with reference to the accompanying drawings, in which:

FIG. 1 is a diagrammatic view of an installation according to the invention comprising one single compressor, and FIG. 2 is a diagrammatic view of the compression line of an installation according to the invention comprising several compressors connected in series.

FIG. 1 shows a helium refrigerating installation of the type described in the abovementioned document FR-A-2 679 635 and essentially comprising a refrigerator 1 delivering after expansion at 2 liquid helium at a first low pressure into an intermediate container 3, from where the liquid is advanced via a line 4 traversing an exchanger 5 and a final expansion element 6 to a second supercold container 7 containing liquid and gaseous helium at a second lower pressure, e.g. of approximately 20 hPa and at a temperature of approximately 2K. The gaseous atmosphere in the container 7 is recompressed in a compression line 8 traversing the exchanger 5 in order to be recycled towards the refrigerator 1.

In the embodiment of FIG. 1, the compression line 8 comprises, downstream of the exchanger 5, a compressor C which can be re-cycled by a re-cycle line 9 provided with a pilot-operated valve $V_1$. The line 8 comprises, between the container 7 and the exchanger 5, a shut-off valve $V_3$ downstream of which a line 10 extending from the line 4 upstream of the expansion element 6 opens. The line 10 comprises a pilot-operated valve $V_2$. The line 8 comprises, between the container 7 and the opening of the line 10, a shut-off valve $V_3$. A first control loop $N_1$ is associated with the compressor C, providing at the output a control signal V for the speed of rotation of the compressor C and receiving moreover a signal $V_R$ representing the speed of rotation of the compressor, a set point $N_{1C}$ produced by a calculating means MC as a function of a calculation using the characteristic of the compressor and which works out a theoretical speed of rotation of the compressor as a function of the temperature T, the pressure P and the flow rate D" at the inlet of the compressor, measured by respective sensors 11, 12 and 13 in the line 8. A second control loop $N_2$ is also associated with the compressor C, providing at the output a control signal for the speed of rotation of the compressor C as a function of a set point $P_C$, which is the nominal suction pressure of the compressor, and of a signal representing the pressure P measured at the inlet of the compressor.

The valve $V_1$ for limiting the flow rate of the gas taken from the container 7 is controlled by a control loop $D_1$ in response to a set point $D_C$ representing the desired fluid flow rate in the compression line for recycling to the refrigerator 1, a flow rate signal D representing, inter alia, the flow rate measured in the line 8 at the outlet of the exchanger 5 and a converted signal of the set point $N_{1C}$. A sensor for the flow rate signal D is provided along line 8 at 14. The valve $V_2$ which allows the expansion element 6 to be by-passed is controlled by a control loop $D_2$ as a function of a set point $D'_c$ representing the desired flow rate in the line 8 upstream of the exchanger 5 and a signal D' representing the fluid flow rate measured in the line 8 upstream of the exchanger 5.

The installation operates as follows:

1. Starting procedure:

1.1. Starting with the container 7, without limitation of flow rate:

The loop $N_1$ keeps the compressor C within the permitted operating zone. If the gas flow rate is insufficient, the speed of rotation increases, as does the compression rate, and the suction pressure in the container 7 is reduced, thereby freeing the desired additional helium flow. Under these conditions, the flow rate required for the correct operation of the compressor is provided dynamically by the container 7. If the speed of the compressor does not increase rapidly enough, the flow rate is too low. On the other hand, if the speed of the compressor increases too rapidly, the flow rate is too high. In both cases, if the flow rate is not adapted to the speed, the compressor can fall out of step. The control loop $N_1$ allows the speed of the pressure reduction in the container 7 to be adapted automatically as a function of the size of the latter, the quantity of liquid helium it contains and the flow emitted at constant pressure by the container as a result of heat losses.

1.2. Starting with the container, with a controlled flow rate:

The flow rate that can be tolerated by the refrigerating installation is limited. It is therefore necessary to ensure correct operation of the compressor C by providing it with a complementary flow by recycling. This is the role of the duct 9 and the loop $D_1$. If the flow rate required by the compressor exceeds the set point value $D_C$ of the loop $D_1$, the valve $V_1$ ensures the complementary flow by recycling. It will be noted that the set point value $D'_c$ of the control loop $D_2$ for the valve $V_2$ corresponds to the flow rate that can be tolerated by the refrigerating installation.

1.3. Starting without the container:

The container 7 is shut off from the compression line 8 by the valve $V_3$, e.g. following recent stoppage of the compression line. Before the line 8 can be connected to the container 7, a pressure equal to that prevailing in the container 7 must be reached in the line 8. Under these conditions, starting is ensured as follows. The set point value $D'_C$ corresponds to the permitted flow rate in the container 7 and the speed of the compressor evolves according to a law fixed in relation to time. When the suction pressure of the compressor is equal to that prevailing in the container 7, the loop $N_1$ is brought into operation, the valve $V_3$ is opened and the valve $V_2$ is gradually closed.

2. Normal conditions:

When the nominal pressure at the inlet of the compressor C has been reached at the end of the starting phase, the valve $V_3$ remaining open, the loop $N_1$ is deactivated and the loop $N_2$ is brought into operation. When this nominal suction pressure is reached, the operation of the system is no longer dynamic as the container 7 can only provide part of the flow at constant pressure corresponding to the static gates. The complementary flow is thus provided by the valve $V_2$, the value of the set point $D'_C$ of the loop $D_2$ corresponding to the minimum permitted flow rate upstream of the line 8 corresponding to the suction pressure.

3. Stoppage:

The stopping phase is preceded by cancellation of the dynamic power resulting from the exchange with the articles cooled by the bath in the container 7, and therefore a reduction in the flow emitted at constant pressure by the container 7. The loop $D_2$ therefore opens the valve $V_2$ and the stopping procedure is as follows. The loop $D_1$ is activated, the valve $V_3$ is gradually closed and, once the latter is closed, the speed of rotation of the compressor decreases according to a law defined in relation to time, until the final stoppage thereof.

FIG. 2 shows an embodiment comprising, as is often necessary, several compressors $C_i$ connected in series. As can be seen in FIG. 2, each compressor $C_i$ is provided with its own control loop $N_1$, the re-cycle line 9 re-cycling all of the compressors and the control loop $N_2$ only affecting the downstream compressor ($C_4$), the input signal being the pressure $P_1$ upstream of the first compressor ($C_1$). The procedures are the same as those described hereinabove, although the evolution of the speeds of rotation as a function of time in the starting phases without the container or stopping phases relates only to the last compressor ($C_4$) provided with the control loop $N_2$.

Although the invention has been described with respect to particular embodiments, it is not limited thereto, but, on the contrary, is subject to modifications and variants obvious to the person skilled in the art.

I claim:

1. In a refrigeration apparatus comprising a container for containing a biphasic fluid at low pressure and low temperature and in fluid communication with a feeding line and with a return line including at least one rotating compressor for compressing gas extracted from the container, the improvement comprising a first fluid flow sensing means for sensing the flow rate of the gas into the return line upstream of the compressor and for generating a first flow signal, and at least a first speed control means responsive to the first flow signal for controlling the rotational speed of the compressor dependent upon the flow rate of gas in the return line.

2. The apparatus of claim 1, further comprising a first derivation line by-passing the compressor, a second fluid flow sensing means for sensing the flow rate of the gas in the return line between the container and the derivation line and for generating a second flow signal, the first derivation line including a first piloted valve responsive to the second flow signal operable to control the flow of gas passing through the compressor.

3. The apparatus of claim 2, wherein the return line comprises a train of at least two serially arranged said compressors, each associated to a said first flow sensing means, the first derivation line bypassing the train of compressors.

4. The apparatus of claim 3, further comprising pressure sensing means for sensing the pressure in the return line upstream of the train of compressors and for generating a pressure signal, and a second speed control means responsive to the pressure signal for controlling the rotational speed of the downstream compressor of the train.

5. The apparatus of claim 2, further comprising a heat exchanger traversed by the feeding line and the return line upstream of the first derivation line.

6. The apparatus of claim 1, further comprising a second derivation line bypassing the container and interconnecting the feeding line and the return line, a third flow sensing means for sensing the flow rate of the gas in the return line downstream of the second derivation line and for generating a third flow signal, the second derivation line including a second piloted valve responsive to the third flow signal to control the flow of gas passing through the compressor.

7. The apparatus of claim 6, further comprising a heat exchanger traversed by the feeding line and the return line downstream of the second derivation line.

8. The apparatus of claim 7, wherein the feeding line comprises an expansion device between the second derivation line and the container.

* * * * *